US009564071B1

(12) United States Patent
Johnson

(10) Patent No.: US 9,564,071 B1
(45) Date of Patent: Feb. 7, 2017

(54) PORTABLE MARKER DEVICE

(71) Applicant: Robert F Johnson, Pinole, CA (US)

(72) Inventor: Robert F Johnson, Pinole, CA (US)

( * ) Notice: Subject to any disclaimer, the term of this patent is extended or adjusted under 35 U.S.C. 154(b) by 0 days.

(21) Appl. No.: 14/886,487

(22) Filed: Oct. 19, 2015

Related U.S. Application Data

(63) Continuation-in-part of application No. 14/171,359, filed on Feb. 3, 2014, now Pat. No. 9,165,488.

(51) Int. Cl.
*G09F 15/00* (2006.01)

(52) U.S. Cl.
CPC ..... *G09F 15/0075* (2013.01)

(58) Field of Classification Search
CPC ..... G09F 15/0075
USPC ..... 248/560, 519, 523, 527, 539; 40/606.01, 40/607.01, 607.03, 607.1, 608; 404/10; 116/63 P, 63 R
See application file for complete search history.

(56) References Cited

U.S. PATENT DOCUMENTS 4,522,530 A * 6/1985 Arthur ..... E02D 5/80 40/608
6,324,800 B1 12/2001 Valentz et al.
6,719,484 B1 * 4/2004 Johnson ..... E01F 9/675 116/63 P
6,886,296 B1 5/2005 John et al.
7,849,617 B2 * 12/2010 Intagliata ..... E01F 9/629 248/160
9,165,488 B1 * 10/2015 Johnson ..... G09F 15/0075

* cited by examiner

*Primary Examiner* — Anita M King
(74) *Attorney, Agent, or Firm* — Theodore J. Bielen, Jr.

(57) ABSTRACT

A support device for a hollow traffic marker utilizing a base having a foot positioned at the ground surface. A boss extends from the base. A flexible sleeve positions over the outer surface of the boss, the hollow traffic marker lies within the flexible sleeve. A gap within the flexible sleeve separates the first and second spacers.

10 Claims, 11 Drawing Sheets

PORTABLE MARKER DEVICE

CROSS-REFERENCES TO RELATED APPLICATIONS

The present application is a continuation-in-part of U.S. patent application Ser. No. 14/171,359, filed 3 Feb. 2014.

PORTABLE MARKER DEVICE

Background of the Invention

The present invention relates to a novel support device for a marker that may take the form of a hollow or solid member.

Traffic markers or posts, referred to as delineators or channelizes, are commonly used on roadways to control traffic flow and to alert operators of vehicles to hazards. Traffic markers extend vertically from the surface of the pavements, specifically functioning to provide visibility or significant distances. Traffic markers are often contacted by vehicles and, thus, such markers require a high degree of flexibility and durability in order to remain in place.

In the past, many marker supports have been proposed. For example, U.S. Pat. No. 6,719,484 shows a novel marker support which is intended to resist vehicle impacts. In this regard, the US patent documents cited in U.S. Pat. No. 6,719,484 are incorporated by reference to the present application, as a whole, to denote the field of invention for the present application.

Unfortunately, vehicles tend to not only graze impact traffic markers, but often are the source of tire run-over and straddle hits. It is estimated that such contact with traffic markers may exert up to 73,000 lbs of force thereupon. Also, following the reception of such run-over and straddle hits, traffic markers must resume an original upright position to function, as heretofore described.

Thus, a support device for a marker which is extremely durable and flexible would be a notable advance in the vehicle traffic arts.

SUMMARY OF THE INVENTION

In accordance with the present invention a novel and useful support device for a marker is herein provided.

The support device of the present invention utilizes a base that includes a foot positioned at the ground surface. The foot maybe held to the ground surface by any suitable fastening means such as gluing, using fasteners such as screws, nails, spikes and the like. In addition, the foot may be weighted to simply lie atop the ground surface or be fixed below ground surface.

A hollow boss is also found in the present invention and extends outwardly from the base. The boss may include a cavity and an outer surface that lies apart from the cavity. Where the boss possesses a cavity, a first spacer is optionally positioned within the boss cavity. The spacer may take the form of a plug that may be composed of any suitable material such as wood, plastic, metal, and the like.

In certain cases, the boss and spacer may be formed as a single unit by molding, machining, or the like. The boss may also be adapted to extend various distances from the base depending on the dimensions of the traffic marker being held by the support device of the present invention. In certain cases, the base may be fashioned onto a single solid unitary member.

At least one fastener and preferably multiple fasteners are used to connect the first spacer to the boss possessing a cavity. The at least one fastener connecting one spacer to the boss includes a portion that extends outwardly from the outer surface of the boss. Where the base is a solid unitary member, a protuberance of various configurations may be used to create an outwardly extending portion.

A flexible sleeve lies over the outer surface of the boss and the fastener portion or protuberance that extends outwardly from the outer surface of the boss. The flexible sleeve may be formed of a very durable elastomeric material such as a spiral wound member. The portion of the at least one fastener extending from the outer surface of the boss may impinge upon the inner surface of the flexible sleeve and tend to deform the flexible sleeve outwardly from the boss to a certain degree.

A second spacer is positioned within the marker having a hollow shape being supported by the device of the present invention. At least a second fastener connects the second spacer to the hollow traffic marker. Again, the at least a second fastener possesses a portion that extends beyond the outer surface of the hollow traffic marker. The hollow traffic marker, the second spacer, and the at least second fastener lie within the flexible sleeve. The positioning of these elements are such that the first and second spacers position apart from each other and form a gap therebetween within the flexible sleeve. A first cinching band surrounds the flexible sleeve adjacent the at least a first fastener portioned extending outwardly from the outer surface of the boss. A second cinching band surrounds the flexible sleeve adjacent the at least a second fastener portion extending outwardly from the outer surface of the hollow traffic marker. The first and second bands are tightening to a degree to create indents to the outer surface of the flexible sleeve, such that the at least first and second fastener outwardly extending portions serve as stops for movement of the flexible sleeve away from the base.

In this regard, at least a third fastener may be employed to connect the second spacer to the hollow traffic marker such that a portion of the third fastener extends outwardly from the outer surface of the hollow traffic marker. The second band, cinched or tightened around the flexible sleeve, would then lie between the at least second and third fasteners to impede movement of the flexible sleeve toward or away from the base.

Where the marker and base are a solid member, a protuberance may be formed thereupon to create an indent to the flexible sleeve when cinched with a band, creating stops akin to the stops hereinabove described with respect to the hollow marker and the base having a boss with a cavity.

The device of the present invention may also include a base in which the spacer and boss include threaded surfaces that threadingly engage one another. In such a case, the first spacer and boss may be formed of a relatively rigid material such as metal, plastic, wood and the like. The cinching band may be located to engage a flange or a portion of the threaded surfaces.

In addition, the first spacer located in a hollow boss extending from the base may include a first plate and a second plate positioned apart from the first plate. The second plate lies against the foot of the base. A threaded bolt may exert a tensioning force to the first and second plates with the spacer lying between the first and second plates.

Another aspect of the present application involves a portable marker support device having a movable base supporting a connected boss. A sleeve overlies the boss and encompasses a spacer within the chamber of the hollow sleeve. A gap is formed between the spacer and the boss within the sleeve chamber. Both the boss and the spacer include recesses along the outer surfaces of the same.

First and second bands are employed to contact the outer surface of the sleeve adjacent the recesses of the boss and spacer, respectively. The marker may also be held to the outer surface of the sleeve by bands. Such bands may include cinching mechanism.

It may be apparent that a novel and useful support device for a marker has been hereinabove described.

It is therefore an object of the present invention to provide a support device for a marker that exhibits high durability from automotive impacts.

A further object of the present invention is to provide a support device for a marker that possesses great flexibility and is capable of resisting a tire run-over as well as a vehicle straddle hit and is capable of recovering to an original vertical position following such impacts.

Another object of the present invention is to provide a support device for a marker or post that is capable of accommodating various manufactured markers or post and is easily capable of effecting interchanging of traffic markers to comply with maintenance schedules.

Another object of the present invention is to provide a support device for a hollow or solid marker that may be placed upon a surface, fixed to a surface, or fixed below a surface for use.

Another object of the present invention is to provide a support for a marker that is durable, flexible and resistant to dislocation.

Another object of the present invention is to provide a support for a post that is capable of accommodating posts of various weights.

Another object of the present invention is to provide a support for a post that includes components that are recyclable.

Another object of the present invention is to provide a support for a post that is economical to manufacture.

The invention possesses other objects and advantages especially as concerns particular characteristics and features thereof which will become apparent as the specification continues.

Further aspects of the invention will be apparent from the drawings which are hereinafter described and should be referenced in conjunction with the specification.

For a better understanding of the invention reference is made to the following detailed description of the preferred embodiments of the invention which should be taken in conjunction with the above described drawings.

DETAILED DESCRIPTION OF THE PREFERRED EMBODIMENTS OF THE INVENTION

Various aspects of the present invention will evolve from the following detailed description of the preferred embodiments thereof which should be referenced to the prior described drawings.

Figure 1:
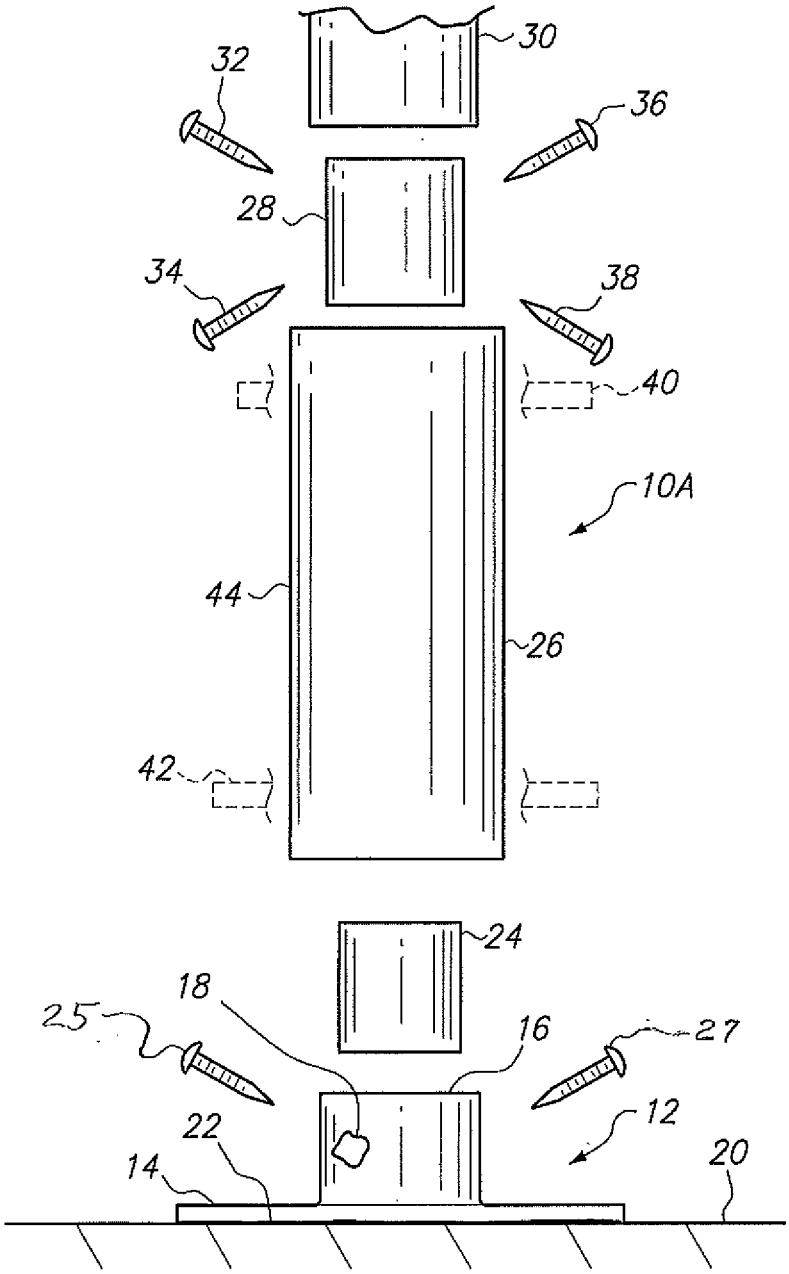
FIG. 1 is a front elevational exploded view of the device of the present application for use with a hollow traffic marker.

The invention as a whole is shown in the drawings by reference character 10. Various embodiments of the invention are further denoted by the addition of an upper case letter. Turning to FIG. 1, it may be observed that device 10A is depicted in an exploded format. Device 10A includes as one of its elements a base 12. Base 12 includes a foot 14 and a hollow boss 16 that extends outwardly from base foot 14. Boss 16 possesses a cavity 18, FIGS. 1 and 4. Base 12 may be formed of any suitable rigid or semi-rigid material. In the embodiment shown in FIG. 1, base 16 is shown as being fashioned of an elastomeric material. Foot 14 is fixed to surface 20 by a connector embodied by mastic 22, although other fastening genre may be employed, such as screws, bolts, nails, spikes, and the like. In addition, foot 14 may simply lie atop surface 20, in which case base 12 would sufficiently weighted to support the remaining portions of device 10A extending upwardly, which will be discussed hereinafter. Further, foot 14 may be positioned below surface 20 following excavation of surface 20 to this effect.

Figure 4:
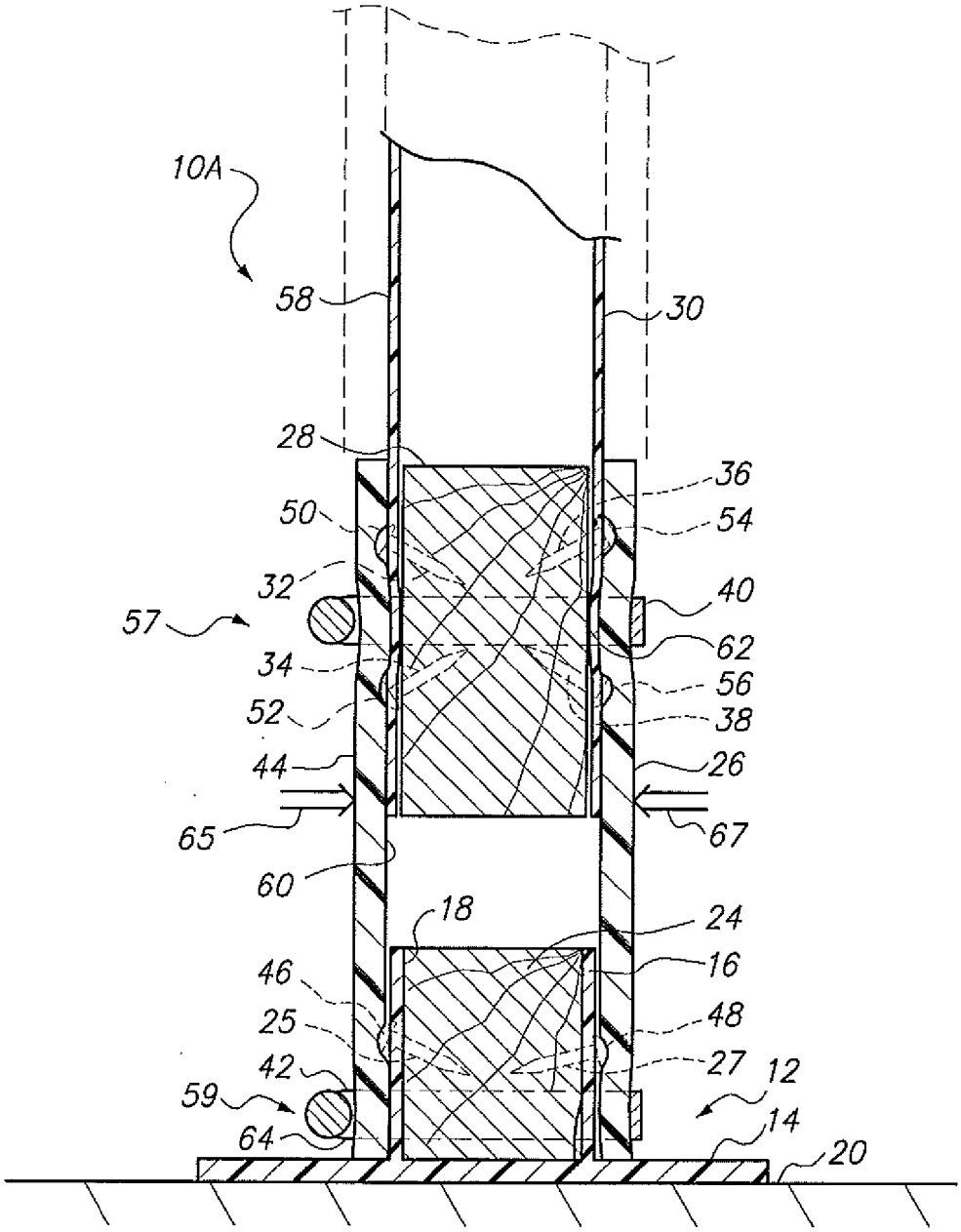
FIG. 4 is a sectional view taken along line 4-4 of FIG. 3.

Device 10A is also formed with a first spacer 24 that is generally illustrated in the form of a plug. First spacer 24 is intended to fit within cavity 18 of hollow boss 16 and fixed there-within by fasteners 25 and 27. As shown in FIG. 4, first spacer 24 is formed of wood, although other materials would be suitable in this regard.

A flexible sleeve 26 is also utilized in device 10A. Flexible sleeve 26 may be formed of a rubberized or fibrous spiral wound cylindrical tube that is highly resistant to impact. Sleeve 26 may be formed of a rubber SBR blend, 60 duro (plus or minus 5) having a 55 degree bias. Sleeve 26 is intended to fit over boss 16, as will be described hereinafter.

In addition, a second spacer 28 is employed in embodiment 10A of the device of the present invention. Second spacer 28 is also shown in the form of a plug and may be composed of wood or other suitable material, as is the case with first spacer 24. Second spacer 28 is intended to fit within hollow traffic marker 30 and held thereto by fasteners 32, 34, 36 and 38. Hollow traffic marker 30 having second spacer 28 there within, is intended to slip into sleeve 26.

Figure 2:
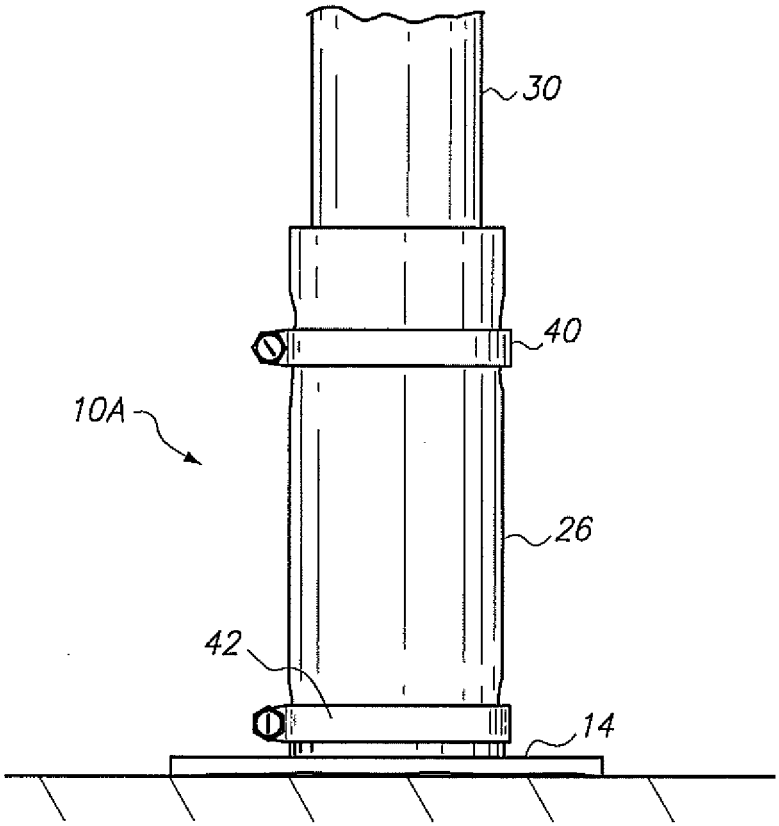
FIG. 2 is a side elevational view of the device of the present invention being employed with a hollow traffic marker in its assembled condition lying atop and fixed to a surface.
Figure 3:
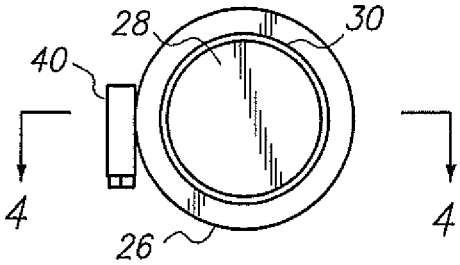
FIG. 3 is a top plan view of the device depicted in FIG. 2.

Cinching bands 40 and 42 are intended to be tightened around the exterior surface 44 of sleeve 26, FIGS. 1, 2, and 4. Turning now to FIGS. 2 and 3, it may be observed that device 10A lies in its assembled condition.

With reference now to FIG. 4, it may be seen that first spacer 24 and second spacer 28 are positioned within cavity 18 of boss 16 and within hollow traffic marker 30, respectively. Fasteners 25 and 27 have been inserted through boss 16 and into first spacer 24. Likewise, fasteners 32, 34, 36, and 38 have been placed through traffic marker 30 and penetrate second spacer 28. It should be noted that the fasteners 25, 27, 32, 34, 36, and 38 include portions that extend outwardly from first and second spacers 24 and 28, respectively. For example, the heads 46 and 48 of fasteners 25 and 27 lie outside of boss 16. By the same token, the heads 50, 52, 54, and 56 of fasteners 32, 34, 36, and 38, respectively, lie outside the outer surface 58 of hollow traffic marker 30. Such portions 46, 48, 50, 52, 54 and 56 of fasteners 25, 27, 32, 34, 36, and 38, respectively, extending outwardly, as described above, impinge on the inner surface 60 of flexible sleeve 26. Deformation of flexible sleeve 26 takes place since flexible sleeve 26 is formed of rubberized material. The tightening of bands 40 and 42, of conventional construction, form indents 62 and 64, respectively, on the outer surface 44 of sleeve 26. Indents 62 and 64, produced by tightened bands 40 and 42 serve as well as portions 46, 48, 50, 52, 54 and 56, as stops 57 and 59 against the movement of sleeve 26 and traffic marker 30 from or toward base 12.

Impact arrows 65 and 67 show possible application of force to device 10 due to vehicular impact from vehicle body portions, tires, and the like. It has been found that device 10A may be bent approximately 90 degrees relative to surface 20 and still return to the upright position depicted in FIGS. 2 and 4.

Figure 5:
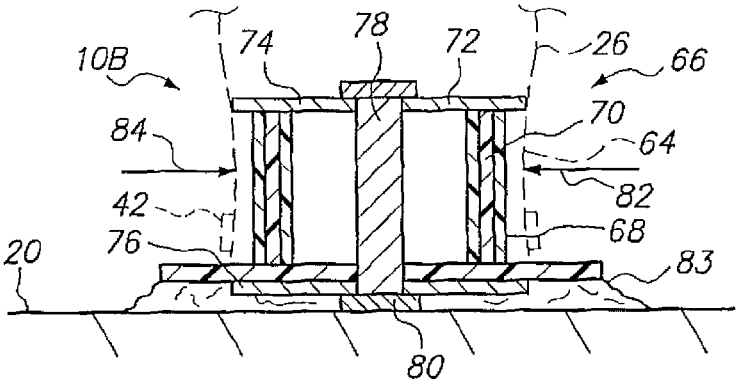
FIG. 5 is a sectional view of an alternate base portion for the device of the present application showing force applied to the same by a tightened band.
Figure 6:
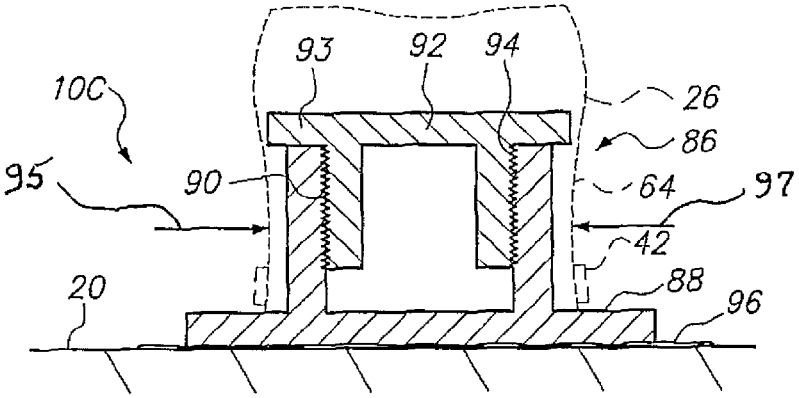
FIG. 6 is a sectional view depicting another embodiment of the base portion of the device of the present application with arrows indicating the force exerted by the band tightened around the base portion depicted therein.
Figure 7:
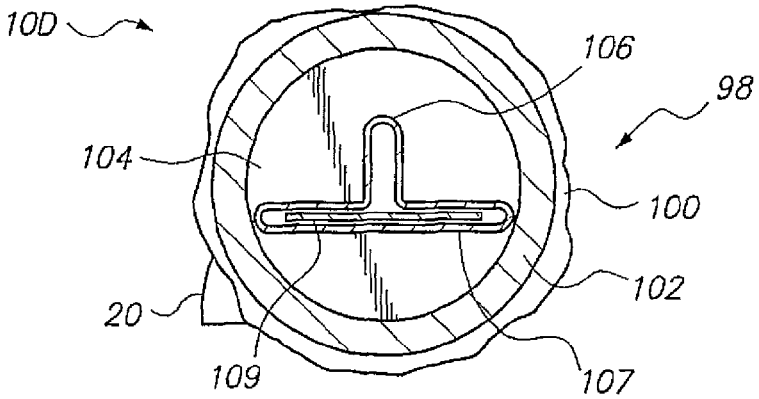
FIG. 7 is a top plan view of another embodiment of the present invention showing a first spacer having a bore to accommodate a traffic marker post having a non-cylindrical configuration.

With reference now to FIGS. 5-7, various alternative embodiments, 10B, 10C, and 10D of the present invention are shown utilizing base members that are intended to be substituted for base 12 hereinabove described. FIG. 5 shows a base member 66 which includes concentric tubes 68, 70, and 72. Plates 74 and 76 lie atop and below, respectively, concentrate tubes 68, 70, and 72. A bolt 78 and nut 80 hold plate 74 and 76 in compression above surface 20. Mastic layer 83 fixes base 66 to surface 20. Flexible sleeve 26, shown in dashed line, extends over base 66. Directional arrows 82 and 84 indicate the formation of indent 64 by a cinching band such as a band 42 depicted in FIGS. 2 and 4. Protruding plate 74 aids in the formation of indent 64.

FIG. 6, depicts another base member 86 in which a metallic coupling 88 is employed having an internal thread 90. A male coupling 92 having an external thread 94 threadingly engages the internal thread 90 of female coupling 88. Again, an indent 64 is formed with respect to flexible sleeve 26 (shown in dashed configuration) by the use of cinching band 42. Protruding top or cap 93 of male coupling 92 aids in such indent 64 formation. Mastic layer 96 fixes base 86 to surface 20. Alternatively, male coupling 92 may extend outwardly from female coupling 88, minus top 93, to allow contact of the threads of male coupling 92 with cinching band 42. Arrows 95 and 97 along the upwardly extended dashed line indicate male coupling 92 without top 93.

FIG. 7 depicts yet another base 98 in which a foot 100 includes a flexible boss or sleeve 102 in the same manner as sleeve 26 depicted in FIGS. 2 and 4. However, optional spacer 104 is employed to lie within boss 102 and includes a channel 106 which is intended to accommodate a hollow traffic marker 107 having a similar shape as channel 106. Again, spacer 104 would be held to flexible boss 102 by fasteners (not shown). Further, a shim 109 may lie within hollow traffic marker 107 to increase the stabilization of traffic marker 107 when engaged by any fasteners. Spacer 104 and shim 109 may be used singly or together with traffic marker 107.

Figure 8:
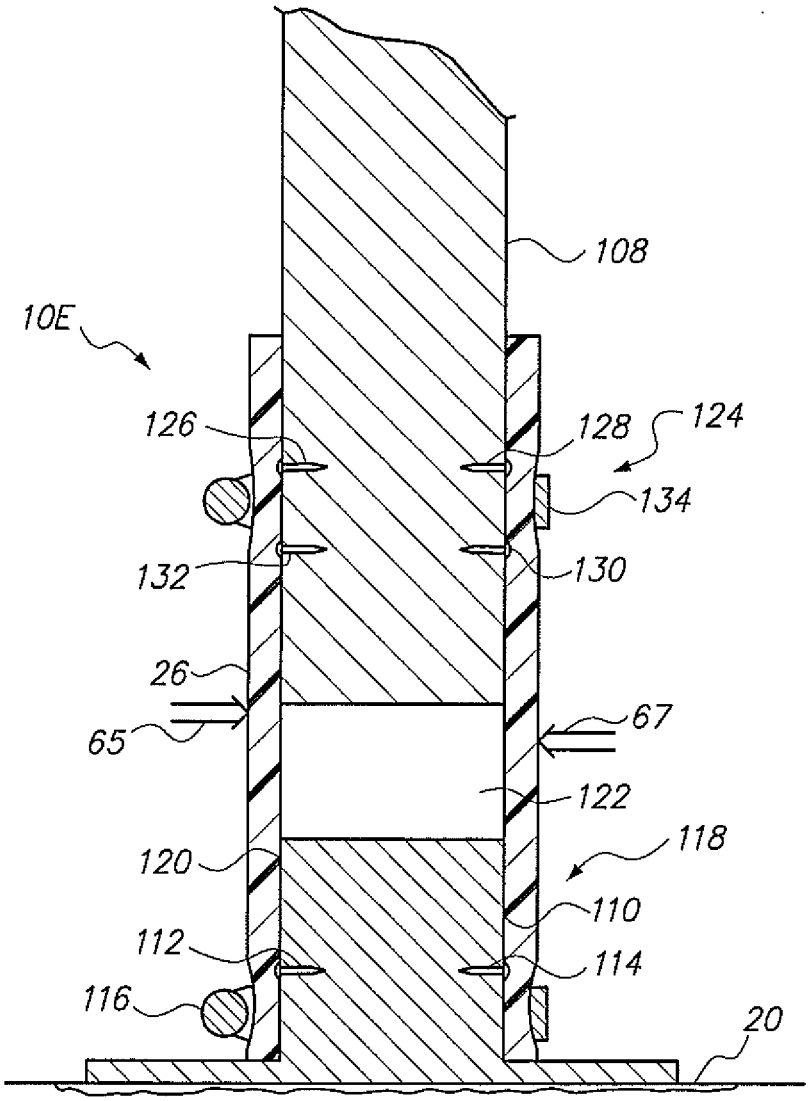
FIG. 8 is a sectional view showing a solid marker and a device of the present application for supporting the same.

FIG. 8 shows another embodiment 10E of the device of the present invention where a solid marker 108 is supported by device 10E. Device 10E includes a solid, unitary base 110 lying on surface 20. Protuberances or flanges 112 and 114, in the form of screws, and cinching band 116 provide the stop 118 against the separation of sleeve 26 from base 110. Of course, other structures, such as a lip, a ring, a flange and the like, may serve to provide a protuberance on the outer surface 120 of base 110. Again, gap 122 lies between base 110 and solid marker 108. A similar stop 124 is created with respect to solid marker 108 by screws 126, 128, 130 and 132 and cinching band 134. As in the case with stop 116 other structures may provide protuberances in conjunction with stop 124.

Figure 9:
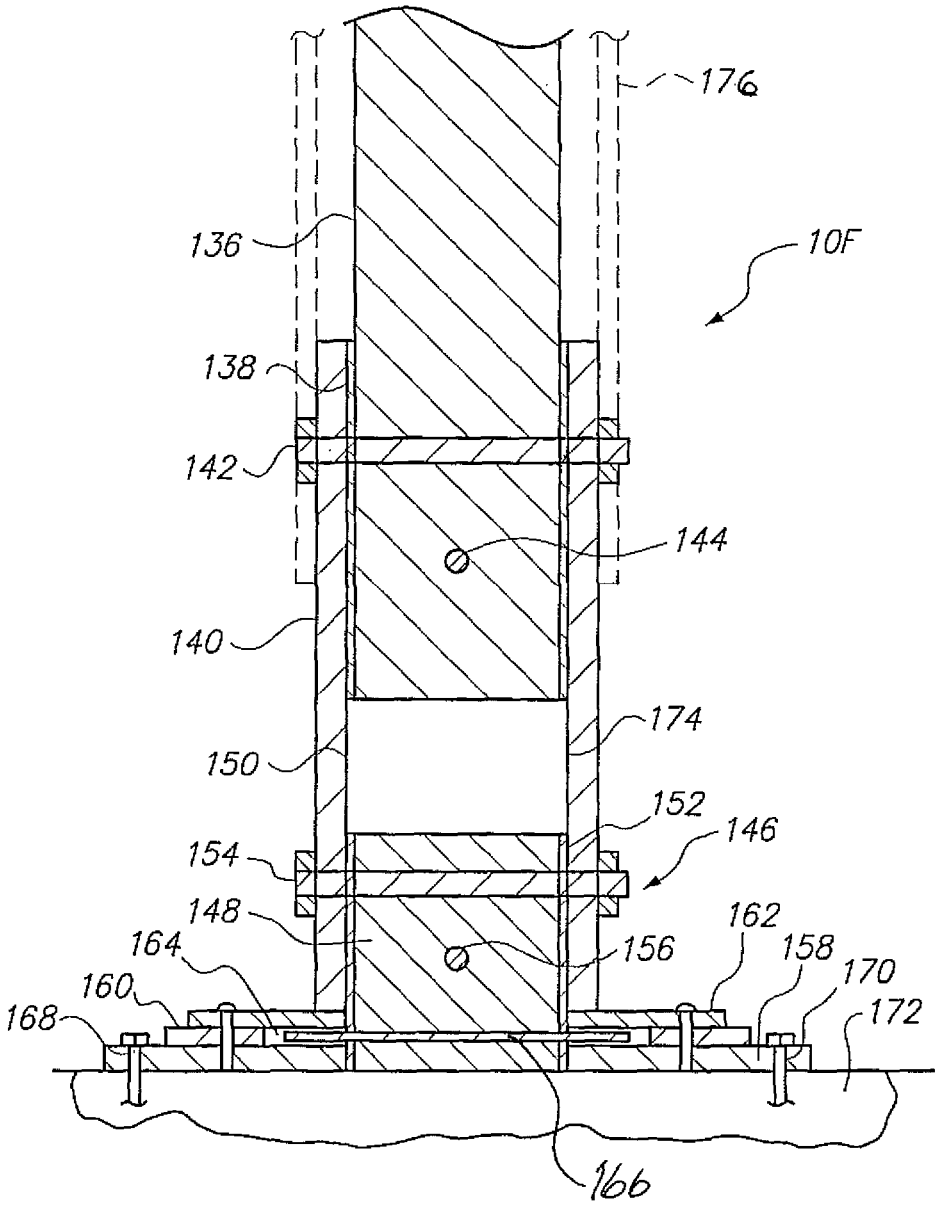
FIG. 9 is a sectional view depicting another embodiment of the present application.

FIG. 9 depicts yet another embodiment 10F of a support using a solid post 136. Post 136 may be used with a shim or spacer 138 depending on the interior dimension of flexible sleeve 140 which is also employed in embodiment 10F. Flexible sleeve is similar to flexible sleeve 26 of FIG. 1. Solid post 136 is held in place by a pair of nut and bolts 142 and 144 that penetrates sleeve 140, shim 138, and solid post 136. Again, a base 146 may also be employed with embodiment 10F. Base includes a spacer 148 placed within chamber 150 of sleeve 140. In addition, an optional shim 152 is depicted in FIG. 9 as lying between spacer 148 and sleeve 140. A pair of nuts and bolts 154 and 156 hold sleeve 140, shim 152, and spacer 148 together. Base 146 also includes plates 158, 160, and 162 which are stacked upon one another. Plate 160 includes a cut-out on slot 164 which accommodates pin 166. Pin 166 penetrates shim 152 and spacer 148 to further stabilize the support of solid post 136. Threaded members 168 and 170 hold base 146 to ground mass 172. Again, gap 174 lies between post 136 and base 146 spacer 148 to allow the flexing of embodiment 10F upon impact. A hollow marker 176 (shown in phantom) may also be used with sleeve 140 and may be held by nut and bolt members 142 and 144 to sleeve 140.

Figure 14:
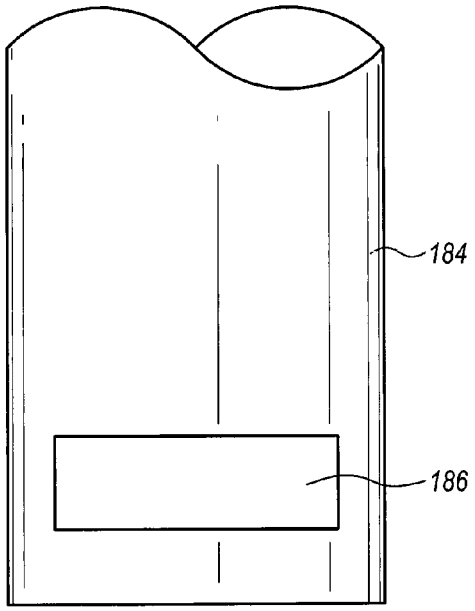
FIG. 14 is a partial front elevational view of a modified marker.

Referring now to FIGS. 10-16, it may be observed that other embodiments 10G and 10H of the device of the present application are illustrated. Support device 10G is used in conjunction with marker 180 which may be a hollow element (shown partially in FIGS. 10 and 13). Marker 180 includes a relieved portion 182 in the form of a series of apertures. With reference to FIG. 14, it may be observed that an alternate marker 184 is shown having a relieved portion 186 in the form of a slot.

Figure 12:
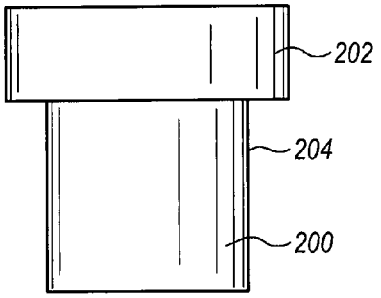
FIG. 12 is a front elevational view of an alternate embodiment of the spacer of FIG. 11.
Figure 13:
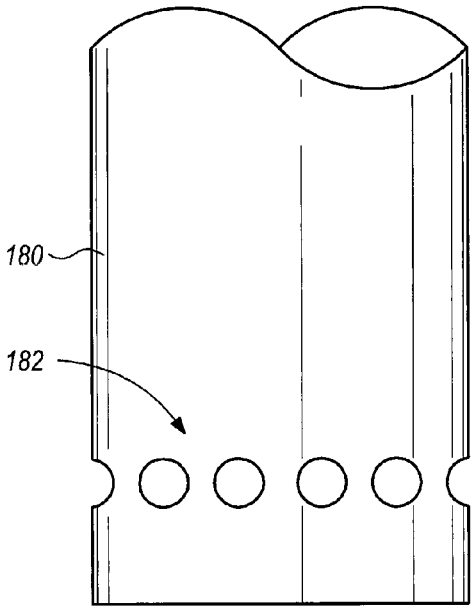
FIG. 13 is a partial front elevational view of a modified marker.

Returning now to FIG. 10, it may be further seen that support device 10G includes a base 188 which is positioned on ground surface 190. Boss 192 is fastened to base 188 by any suitable means such as unitary molding or by the use of mastic layer 194 and the like, shown in FIG. 10. A bolt and nut 195 may also be employed to link base 188 to boss 192 (shown in phantom on FIG. 15). Base 188 may also be fixed to ground surface 190 or formed of a weighted material, such as metal, to anchor device 10G to ground surface 190. Boss 192 is formed with an outer surface 196 and a recess 198, FIGS. 10 and 11. FIG. 12 depicts an alternate embodiment for boss 192 in which a boss 200 is depicted. Boss 200 also includes an outer surface 202 and a recess 204 in the form of a lip or overhang.

Figure 10:
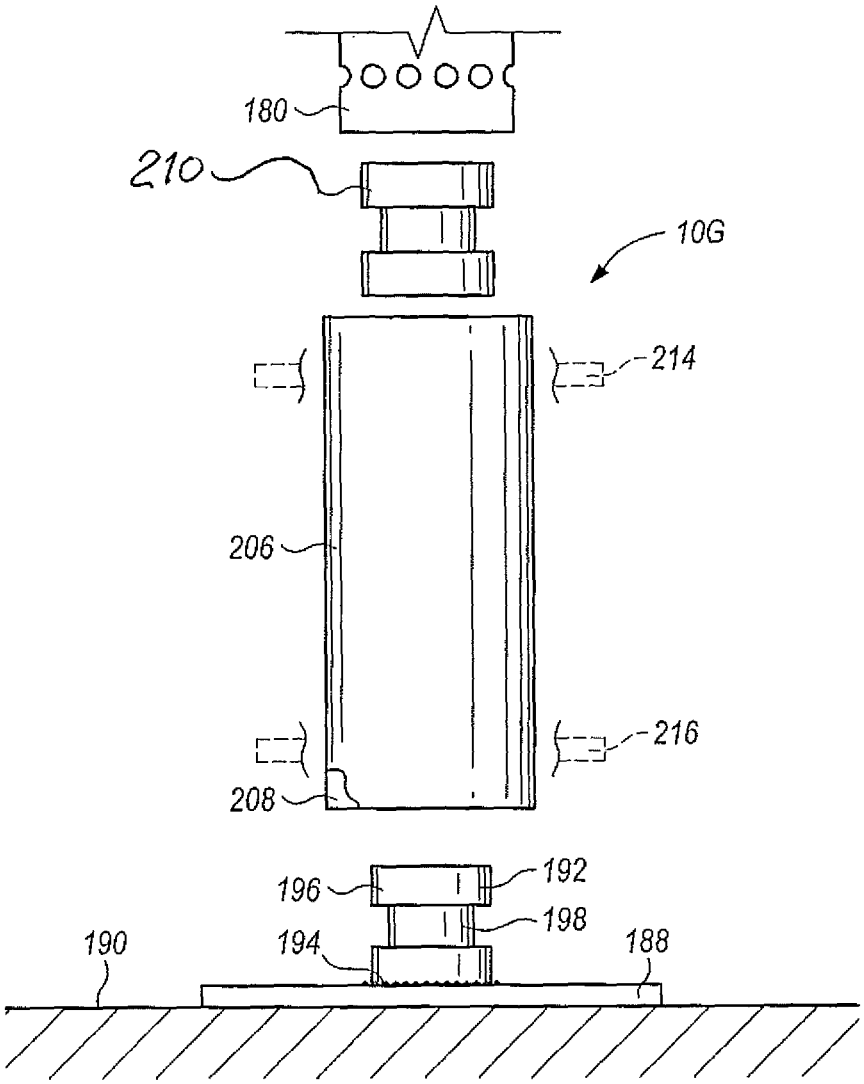
FIG. 10 depicts yet another embodiment of the device of the present application in a front exploded, elevational view.
Figure 11:
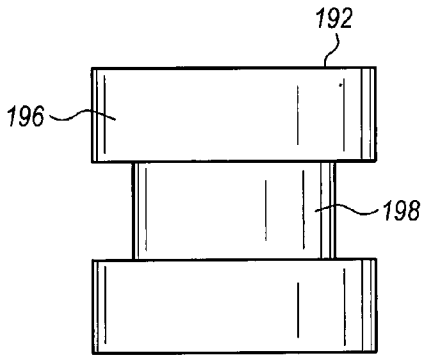
FIG. 11 is a front elevational view of the spacer element of FIG. 10.

With further reference to FIG. 10, it may also be apparent that device 10G includes a flexible sleeve 206, similar to flexible sleeve 26 of FIG. 1. Flexible sleeve 206 is a hollow member that includes a chamber 208 therewithin. A spacer 210 is also included in embodiment 10G and is similarly constructed to boss 192. Bands 214 and 216, which may be cinched, are depicted in phantom on FIG. 10 and will be further discussed as the specification continues.

Figure 15:
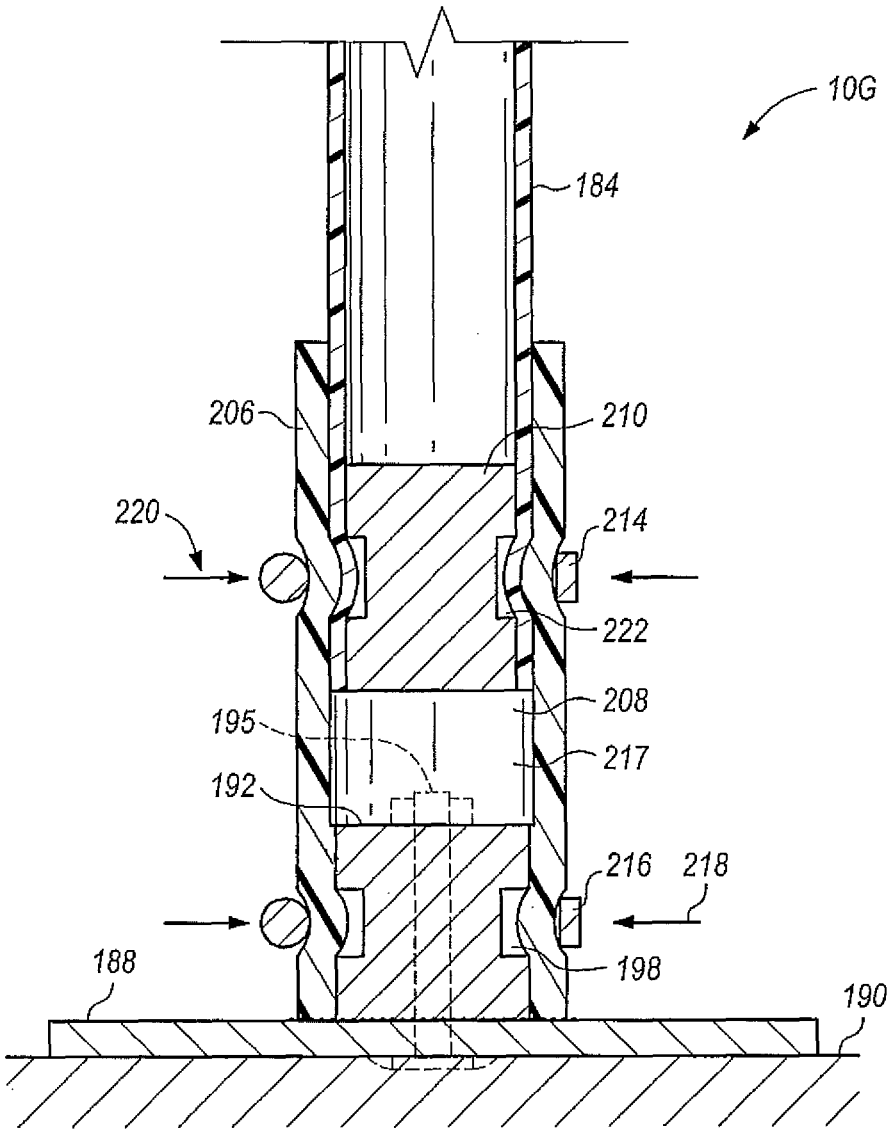
FIG. 15 is an axial sectional view of the embodiment of FIG. 10 in its assembled configuration.

Referring now to FIG. 15, it may be observed that embodiment 10G has been assembled for use. Flexible sleeve 206 lies over boss 192 and spacer 210 and forms a gap 217 therebetween within chamber 208 of flexible sleeve 216. Band 216 is tightened against boss 192 to allow flexible sleeve 206 to move into recess 198 of boss 192, directional arrows 218. Likewise, spacer 210 is cinched by band 214 such that a portion of marker 184 and flexible sleeve 206 extends into recess 222, directional arrows 220. Thus, Bands 214 and 216 squeeze flexible member 206 against boss 192 and spacer 210 and partially fill recesses 198 and 222 of the same, respectively.

Figure 16:
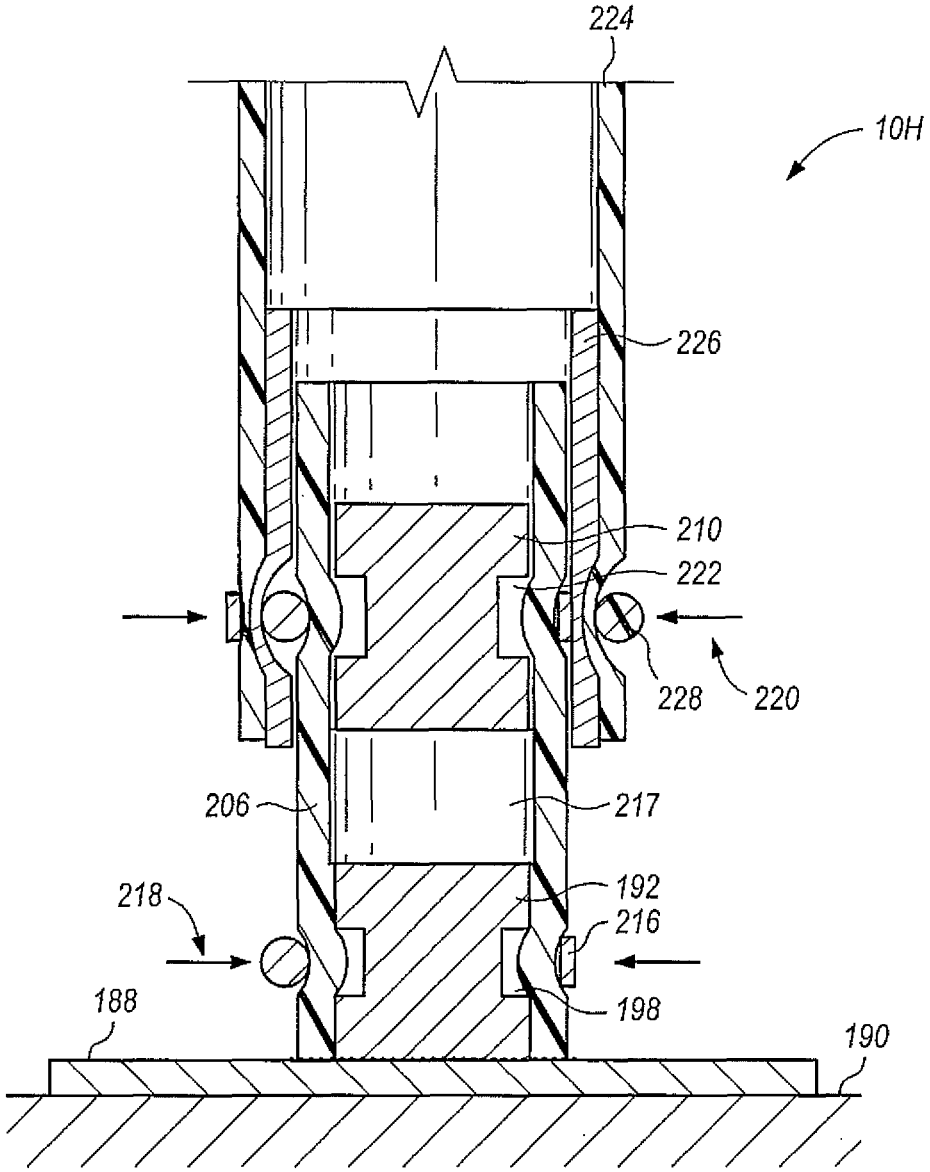
FIG. 16 is a sectional view of the device of the present application with the supported marker overlying the flexible sleeve.

Referring now to FIG. 16, embodiment 10H is revealed. Embodiment 10H is intended to illustrate a support of a marker 224 that lies over flexible sleeve 206 rather than within flexible sleeve 206, as is illustrated in FIG. 15. A filler 226, in the form of a hollow cylindrical member, may be employed to lie between the outer surface of flexible sleeve 206 and the inner surface of marker 224. A cinching band 228 constricts or squeezes the outer surface of marker 224 against filler 226 to hold marker 224 in place. With further reference to FIG. 16, embodiment 10H of the present invention uses similar elements of embodiment 10G that are shown in FIGS. 10 and 15. Notably, base 188 lies atop of ground surface 190. Boss 192 and spacer 210 lie within flexible sleeve 206 and form a gap 217 therebetween.

Figure 17:
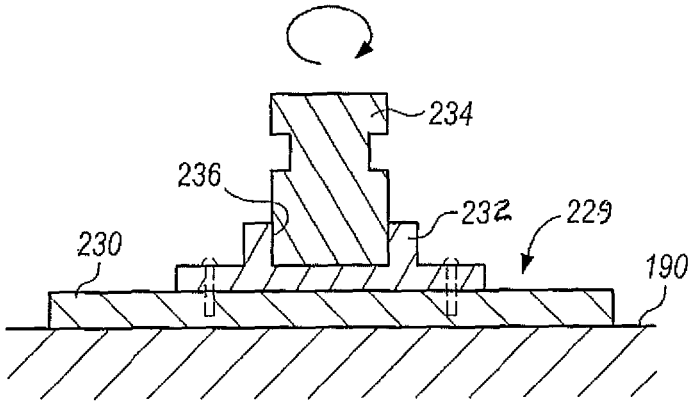
FIG. 17 is a sectional view of an alternate base portion of the device of the present application.
Figure 18:
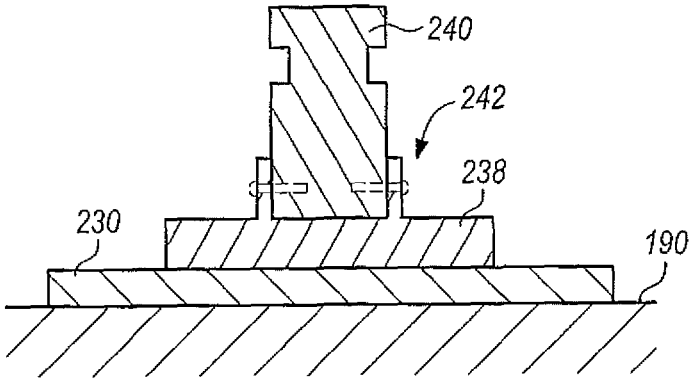
FIG. 18 is a sectional view of an alternate base portion of the device of the present application.

Looking at FIGS. 17 and 18 variations to base 188 are shown for use with heavier markers. FIG. 17 shows a base 229 utilizing a plate 230 and a threaded receiver 232. Boss 234 is similarly constructed to boss 192 of FIG. 10 with the addition of a threaded bottom that threadingly engages receiver 232 at threaded surfaces 236. FIG. 18 depicts a cup 238 that holds boss 240 by a multiplicity of fasteners 242.

In operation, the user places device 10A on surface 20 fixes the same to the surface by the use of a mastic connector, such as mastic layer 22 of FIG. 1. Base 12, 66, 86, and 98 may be employed with respect to devices 10A, 10B, 10C, 10D, and E respectively. Sleeve 26 is placed over a particular base and held thereto by band 42. Hollow traffic marker 30 is then fixed to second spacer 28 by fasteners 32, 34, 36, and 38 and placed within sleeve 26. Band 40 is then cinched against the exterior wall 44 of sleeve 26 between the protruding portions 50, 52, 54, and 56 of fasteners 32, 34, 36, and 38, respectively, creating stops 57 and 59 against movement of sleeve 26. Bands 116 and 134 create stops 118 and 124 with screws 112, 114, and screws 126, 128, 13C and 132, respectively, in embodiment 10E, FIG. 8. Of course, devices 10A, 10B, 10C, 10D, 10E and 10F may be simply placed upon surface 20 or buried below surface 20 following excavation for use. It has been found that devices 10A, 10B, 10C, 10D, 10E and 10F exhibit extreme durability when impacted by vehicles and the like according to force arrows 65 and 67 depicted in FIGS. 4 and 8. That is to say, traffic marker 30 may be rotated 90 degrees toward surface 20 and spring back to the upright position shown in FIG. 2 following such impact. In addition such impact would similarly occur without damages to devices 10A, 10B, 10C, 10D, 10E, 10F, 10G and 10Hs.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A support device for positioning a marker above ground surface, comprising:

a base, said base positioned at the ground surface;

a boss, said boss being connected to said base and extending outwardly therefrom, said boss including an outer surface having a recess;

a flexible sleeve for positioning the marker flexible sleeve overlying said boss recess, said flexible sleeve having a chamber there within at least partially encompassing said boss;

a spacer positioned within said chamber of said flexible sleeve apart from said boss to form a gap therebetween, said spacer possessing an outer surface having a recess;

a first band, said first band surrounding said flexible sleeve adjacent said recess of said outer surface; and a second band surrounding said flexible above sleeve adjacent said recess of said spacer and the marker.

2. The device of claim 1 in which the marker is positioned within said flexible sleeve.

3. The device of claim 2 in which the marker includes a hollow portion and said spacer fits within the hollow portion of the marker.

4. The device of claim 1 in which the marker includes a hollow portion and the marker hollow portion overlies said flexible sleeve.

5. The device of claim 1 which additionally comprises a filler, said filler interspaced said flexible sleeve and the marker hollow portion.

6. The device of claim 1 in which said second band further comprises a cinching mechanism.

7. The device of claim 6 in which the marker is positioned within said flexible sleeve.

8. The device of claim 7 in which the marker includes a hollow portion and said spacer fits within the hollow portion of the marker.

9. The device of claim 6 in which the marker includes a hollow portion and the marker hollow portion overlies said flexible sleeve.

10. The device of claim 9 which additionally comprises a filler, said filler interspaced said flexible sleeve and the marker hollow portion.

* * * * *